137-13 SR
7/10/79 OR 4,160,459

United States Patent [19]
Sweeney

[11] 4,160,459
[45] Jul. 10, 1979

[54] LOW POUR CRUDE OIL COMPOSITIONS

[75] Inventor: William M. Sweeney, Wappingers Falls, N.Y.

[73] Assignee: Texaco Inc., White Plains, N.Y.

[21] Appl. No.: 854,305

[22] Filed: Nov. 23, 1977

[51] Int. Cl.[2] ..... H01M 4/20
[52] U.S. Cl. ..... 137/13; 44/62; 44/70
[58] Field of Search ..... 44/62, 70; 526/320; 137/13

[56] References Cited

U.S. PATENT DOCUMENTS 3,467,597 9/1969 Tunkel et al. ..... 44/62

*Primary Examiner*—Patrick Garvin
*Assistant Examiner*—Y. Harris-Smith
*Attorney, Agent, or Firm*—Carl G. Ries; Thomas H. Whaley; Walter D. Hunter

[57] ABSTRACT

A low pour crude oil composition is prepared by incorporating into a waxy crude oil an effective pour depressant amount of an oil-soluble terpolymer, such as a vinyl acetate-ethylene-methacrylic or acrylic acid ester terpolymer. The terpolymer may be added with mixing directly to the heated crude or in hydrocarbon solution such as a solution of the terpolymer in a middle distillate or kerosene. In another aspect, this invention relates to a process for the pipeline transportation of the low pour point crude oil composition previously described.

6 Claims, No Drawings

LOW POUR CRUDE OIL COMPOSITIONS

BACKGROUND OF THE INVENTION

1. Field of the Invention

This invention is concerned with means for providing low pour crude oil compositions containing a waxy crude and an effective pour depressant amount of an oil-soluble terpolymer.

2. Description of the Prior Art

Certain waxy crude oils, such as the high-pour crude oils, exhibit poor flow properties. A number of processes have been suggested in the art for dealing with such flow problems. For example, the pour point of waxy crudes has been improved by the removal of a part of the wax by solvent extraction at low temperatures, with the attendant expense of recovering the solvent, and the problem of disposing of the wax and of providing the cooling requirements which are substantial. In more recently proposed processes, wax has been removed without the use of a solvent by centrifuging a previously heated crude which has been cooled at a critically controlled and slow rate to a centrifuging temperature of around 35°-55° F.

Another widely practiced process involves cutting the waxy high-pour crudes with lighter fractions of hydrocarbons. This process suffers from a number of disadvantages, such as the fact that the procedure involves the use of relatively large amounts of expensive hydrocarbon solvents to transport a relatively cheap product. Furthermore, this practice also necessarily requires that the cutting hydrocarbon solvents be available in suitable quantities which in some instances is inconvenient, and also that there be a ready market for the solvents at the other end of the pipeline.

In transporting waxy crudes with high pour points by one method, heating equipment along the pipeline at frequent intervals is utilized to heat the crude and thus reduce its viscosity. Heaters employed for this purpose can be operated by withdrawing from the crudes being transported for use as fuels. As much as 5 percent of the crude may be utilized in providing the heating necessary for reducing the crude oil viscosity to a suitable value. Furthermore, most pipelines are not equipped with such heating installations. Also, there is the additional problem of contamination of the atmosphere when burning crude oils since they may be difficult to burn completely.

A principal object of this invention is to provide a crude oil composition which possesses an improved pour point and flow properties.

BRIEF DESCRIPTION OF THE INVENTION

In its broadest aspect this invention relates to low pour crude oil compositions comprising a waxy crude oil containing an effective pour depressant amount of an oil-soluble terpolymer. Terpolymers useful in these crude oil compositions include vinyl acetate-ethylene-methacrylate or acrylic ester terpolymers as well as vinyl acetate-ethylene-ethoxylated or propoxylated acrylic acid terpolymers. In another aspect this invention relates to a process for the pipeline transportation of the above-described crude oil compositions.

DETAILED DESCRIPTION OF THE INVENTION

Although the crude oil compositions of this invention may be prepared using any crude oil the terpolymer pour depressants as previously described are particularly effective with high pour, waxy crude oils.

Waxy crude oil useful in preparing the novel crude oil compositions of this invention include, for example, the high-pour, high-wax, low-sulfur crude oils having an API gravity of about 30 to about 40; a sulfur content of between about 0.10 and about 2.0 percent by weight; a Saybolt viscosity at 100° F. of about 20 to about 100 SUS; a wax content of between about 3 and 20 percent by weight; and a pour point between about 40° and about 100° F. A waxy, high-pour, low-sulfur crude oil which has been given particularly good results in the low-pour point oil compositions of this invention is known as "Amna" crude and has an API gravity of about 36.0; a Saybolt viscosity of about 69.8 SUS at 100° F.; a pour point of about +70° F.; a wax content of about 14.0 weight percent; and a sulfur content of about 0.15 weight percent. Mixtures of the high-pour, low-sulfur, waxy crude oils may be utilized in preparing the crude oil compositions of this invention, if desired.

The oil-soluble terpolymers useful in preparing the low pour crude oil compositions of this invention are of two types. The first of these includes terpolymers comprising recurring units of:

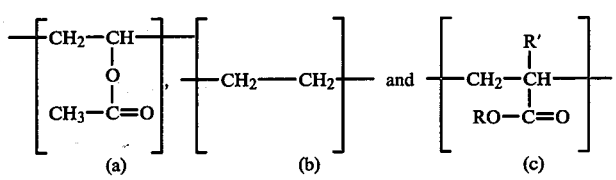

(A)

wherein R is straight chain or normal alkyl having about 10 to about 26 carbon atoms and mixtures thereof and R' is selected from the group consisting of hydrogen and —$CH_3$.

In preparing the methacrylic or acrylic esters employed in this invention in terpolymer A, straight chain or normal saturated monohydric aliphatic alcohols having from about 10 to about 26 carbon atoms are employed. Examples of such alcohols include decyl, dodecyl, hexadecyl, heptadecyl, etc. If desired, mixtures of these alcohols may be utilized. Such long chain normal alcohols are available commercially although generally the commercial products are mixtures of the long chain materials and frequently a small amount of branched long chain alcohols and other impurities are present in the commercially available materials. A particularly useful group of commercial alcohols are the straight chain saturated monohydric aliphatic alcohols sold under the trade name of "Alfol" alcohols which are manufactured by The Continental Oil Company, New York, N.Y.

The second type of polymer suitable for use in the crude oil compositions of this invention includes terpolymers comprising recurring units of:

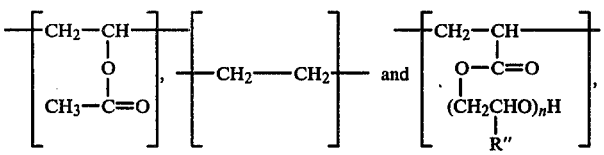

(d) (e) (f)

(B)

wherein R″ is selected from the group consisting of —$CH_3$ and hydrogen and n is an integer of from 1 to about 5 and preferably 1 to 2. The number average molecular weights of the terpolymers A and B utilized in this invention will range from about 5000 to about 85,000 or more and preferably will be from about 15,000 to about 50,000.

In terpolymer A above the weight percent of the a units (i.e., vinyl acetate units) is about 20 to about 45; the weight percent of b units (i.e., ethylene units) is about 50 to about 79 with the c units (i.e., methacrylate or acrylic ester units) being the balance. Likewise in terpolymer B above the weight percent of d units (i.e., vinylacetate units) is about 20 to about 45; the weight percent of e units (i.e., ethylene units) is about 50 to 79 with the f units (i.e., alkoxylated acrylic acid units) being the balance.

Preparation of terpolymer types A and B above is conducted using processes well known in the art. For example, in preparing a Type A terpolymer a mixture of the required methacrylic or acrylic ester and vinylacetate is added to autoclave containing as a solvent a quantity of benzene, toluene, xylene, etc. following which the autoclave is purged with an inert gas such as nitrogen, argon, etc. and then with ethylene to a pressure of about 700 to about 4000 psig. Next a free radical type catalyst such as di-tert. butyl peroxide in, for example, benzene is pressurized into the autoclave over a period of from about 1 to about 5 hours or more during which time the temperature and pressure are usually maintained constant. Finally, the terpolymer product is recovered by stripping from the reaction mixture unreacted materials. Terpolymers of Type B are prepared in the same manner as the Type A polymers. The oxyalkylated acrylic acid used in preparing terpolymer B compounds is prepared by conventional methods in which ethylene oxide or propylene oxide is reacted with acrylic acid in a suitable solvent at a temperature of about 100° C. in an autoclave in the presence of a basic catalyst.

The amount of the terpolymer pour depressant incorporated into the crude oil compositions of this invention may be varied over a wide range. Generally the amount of the terpolymer in the crude oil composition will vary from about 0.01 to about 0.50 weight percent and preferably between about 0.02 to about 0.25 weight percent.

The required amount of terpolymer A or B may be added with mixing directly to the crude oil which may be heated, if desired. Preferably, the terpolymer is added to the residual fuel in solution form dissolved in a hydrocarbon such as benzene, toluene, xylene, kerosene, etc., at a temperature of about 70° to about 200° C. with mixing. Generally, the concentration of terpolymer A or B in the hydrocarbon solution will be from about 0.5 to about 10 or more weight percent.

The following example illustrates one embodiment of this invention and is to be considered not limitative.

EXAMPLE I

A mixture of 220 g. of vinyl acetate, 22 g. of the methacrylic ester of Alfol 1216 (a mixture of normal alcohols ranging from $C_{12}$ to $C_{16}$) is metered into an autoclave containing 840 cc. benzene that was purged with $N_2$, then with ethylene. The mixture is heated to 150° C. and pressurized with ethylene to 3000 psig. Twenty-two g. of di-tert butyl peroxide in 66 g. of benzene is also metered in over a period of 2 hours. The temperature and pressure are kept constant over this time. The terpolymer when stripped of unused reactants contains 28 weight percent vinyl acetate, 3 weight percent Alfol 1216 methacrylate and the balance ethylene and has a number average molecular weight of about 23,000.

A crude oil composition is prepared by adding a sufficient amount of the above prepared terpolymer to Amna crude so that the concentration of the additive is 0.12 weight percent. The pour point of this composition is determined by the method of ASTM D-97 and found to be substantially below that of the Amna crude alone.

In another aspect, this invention relates to an improved process for the transportation of the novel crude oil compositions described in detail above.

The improved process of this invention for the pipeline transportation of the crude oil composition described above comprises introducing into the said pipeline a crude oil composition comprising a waxy, crude oil and an effective pour depressant amount of terpolymer A or B. Generally, the amount of the terpolymer will range from about 0.01 to about 0.50 weight percent.

EXAMPLE II

A type B terpolymer (Terpolymer I) consisting of about 35 weight percent of vinyl acetate, about 52 weight percent ethylene and with the balance being units of the formula:

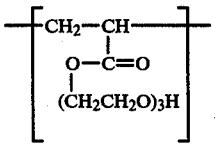

is prepared in the manner previously described. The resulting viscous random terpolymer, which exhibits a number average molecular weight of about 31,000, is dissolved in toluene with mixing at a temperature of 80° C. to form a 5 weight percent solution.

A crude oil composition is prepared by adding with mixing at a temperature of 110° C. sufficient of the above-prepared solution of Terpolymer I to Amna crude so that the concentration of the additive is 0.08 weight percent. The pour point of this crude oil composition is determined by the method of ASTM D-97 and found to be substantially below that of Amna crude alone.

What is claimed is:

1. A residual fuel oil composition having improved pour point characteristics comprising a waxy crude oil and an effective pour depressant amount of an oil-soluble terpolymer comprising recurring units of:

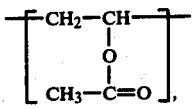

$\text{+CH}_2\text{—CH}_2\text{+}$ and

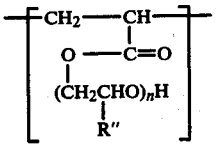

wherein R″ is selected from the group consisting of $\text{—CH}_3$ and hydrogen and n is an integer of from 1 to 5.

2. The composition of claim 1 wherein the said terpolymer comprises about 35 weight percent vinyl acetate, about 13 weight percent units of the formula

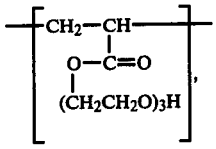

and with the balance being ethylene.

3. The composition of claim 1 wherein the amount of the said terpolymer employed is about 0.01 to about 0.50 weight percent.

4. The composition of claim 1 wherein the number average molecular weights of the said terpolymers will range from about 5000 to about 85,000.

5. The composition of claim 1 wherein the number average molecular weights of the said terpolymers will range from about 15,000 to about 50,000.

6. In the transportation of crude oils, the improvement which comprises introducing into a pipeline the crude oil composition of claim 1.

* * * * *